US010161073B2

(12) United States Patent
Moreira et al.

(10) Patent No.: US 10,161,073 B2
(45) Date of Patent: Dec. 25, 2018

(54) FLOATING COUPLING SYSTEM FOR LAUNDRY APPLIANCE EQUIPMENT

(71) Applicant: Whirlpool S.A., Sao Paulo (BR)

(72) Inventors: Anderson Luis Camargo Moreira, Sao Paulo (BR); Rodrigo Estorino Costa, Sao Paulo (BR)

(73) Assignee: Whirlpool S.A., Sao Paulo (BR)

( * ) Notice: Subject to any disclaimer, the term of this patent is extended or adjusted under 35 U.S.C. 154(b) by 69 days.

(21) Appl. No.: 15/220,955

(22) Filed: Jul. 27, 2016

(65) Prior Publication Data

US 2017/0030003 A1 Feb. 2, 2017

(30) Foreign Application Priority Data

Jul. 27, 2015 (BR) ..... 102015017857

(51) Int. Cl.

| | |
|---|---|
| ***D06F 37/26*** | (2006.01) |
| ***D06F 37/12*** | (2006.01) |
| ***D06F 37/30*** | (2006.01) |
| ***D06F 37/40*** | (2006.01) |

(52) U.S. Cl.

CPC ..... *D06F 37/268* (2013.01); *D06F 37/12* (2013.01); *D06F 37/304* (2013.01); *D06F 37/40* (2013.01)

(58) Field of Classification Search

CPC ..... D06F 37/12; D06F 37/26; D06F 37/268; D06F 37/30; D06F 37/304; D06F 37/40

USPC ..... 68/12.24, 140

See application file for complete search history.

(56) References Cited

U.S. PATENT DOCUMENTS

| | | | | |
|---|---|---|---|---|
| 3,832,870 | A * | 9/1974 | Todd-Reeve | D06F 17/04 134/112 |
| 4,837,882 | A * | 6/1989 | Brenner | D06F 37/40 192/18 R |
| 5,381,677 | A * | 1/1995 | Park | D06F 13/02 68/133 |
| 5,586,455 | A | 12/1996 | Imai et al. | 68/12.02 |
| 5,651,277 | A * | 7/1997 | Richardson | D06F 37/40 68/133 |
| 6,202,451 | B1 * | 3/2001 | Park | D06F 37/40 68/133 |
| 6,634,193 | B2 | 10/2003 | Lee et al. | 68/23.6 |

(Continued)

FOREIGN PATENT DOCUMENTS

| | | |
|---|---|---|
| BR | PI 8806595 A | 8/1989 |
| BR | PI 0605507-9 A | 10/2007 |

(Continued)

*Primary Examiner* — Joseph L. Perrin
(74) *Attorney, Agent, or Firm* — Price Heneveld LLP

(57) ABSTRACT

A laundry appliance includes a clutch/coupler floating member positioned between basket and stirrer and provides selective and automatic coupling therebetween according to the phase of the washing cycle. At least one coupler cooperates pivotally and simultaneously with the moving basket and the stirrer. The coupler comprises a stem rotatably hinged to a pivot which cooperates with the basket and is disposed orthogonal to the longitudinal axis of the stirrer, wherein a rod end of the coupler cooperates with at least one first coupling member and the other end of the rod cooperates with at least one floating body. The basket comprises at least one housing cooperating with the floating body of the coupler. The stirrer comprises a coupling cooperating with the first coupling member of the coupler.

9 Claims, 3 Drawing Sheets

(56) References Cited

U.S. PATENT DOCUMENTS

| | | | | |
|---|---|---|---|---|
| 6,880,192 | B2 * | 4/2005 | Lee | D06F 37/40 68/23.6 |
| 6,951,121 | B2 | 10/2005 | Lee et al. | 68/12.02 |
| 2013/0276483 | A1 * | 10/2013 | Ryu | D06F 37/40 68/12.24 |
| 2013/0312462 | A1 | 11/2013 | Kim et al. | 68/133 |
| 2014/0182066 | A1 | 7/2014 | Chang et al. | 8/137 |

FOREIGN PATENT DOCUMENTS

| | | | |
|---|---|---|---|
| BR | PI 1103238-3 | A2 | 7/2013 |
| CN | 2256898 | Y | 6/1997 |
| CN | 201151827 | Y | 11/2008 |
| CN | 202193983 | U | 4/2012 |
| CN | 203411812 | U | 1/2014 |
| CN | 203440675 | U | 2/2014 |
| JP | 3493120 | B2 | 2/2004 |
| KR | 20030024962 | A | 3/2003 |
| KR | 20070055109 | A | 5/2007 |

* cited by examiner

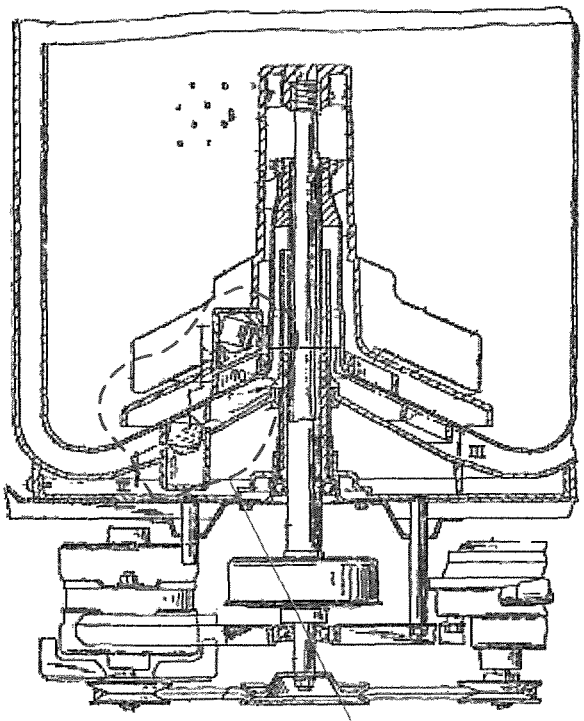
FIG. 1.1
(Prior Art)
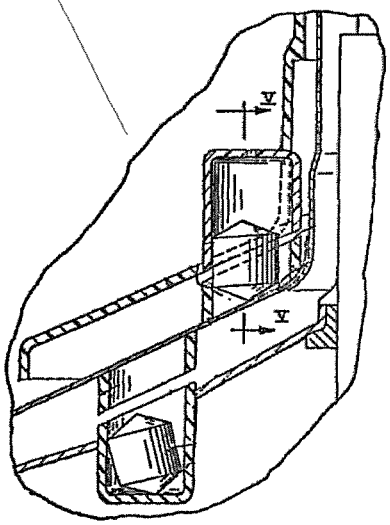
FIG. 1.2
(Prior Art)

FLOATING COUPLING SYSTEM FOR LAUNDRY APPLIANCE EQUIPMENT

FIELD OF THE INVENTION

The present invention relates to a laundry appliance equipment provided with clutch/floating coupler member positioned between the basket and stirrer. This invention is primarily aimed at providing selective coupling between said components according to the phase of the washing cycle, said coupling being performed automatically.

BACKGROUND OF THE INVENTION

Laundry appliances equipment are commonly provided with internal rotating baskets and arranged concentrically to tanks associated with these by means of suspension members, all being surrounded by a structural enclosure. In the case of washing machine with vertical axis and upper opening further exists a stirrer arranged inside the rotary basket and comprising a rotation axis cooperating with an electric engine.

According to the teachings available in the art, several expedients are known for providing selective coupling between the various parts/components of furniture such washing machines, especially between the rotating basket and the stirrer unit.

Thus, it is known the solution of the JP03493120 document, which talks about a selective coupling between the rotating basket and the stirrer of a washing machine, said coupler basically formed by a pivoting lever around an axis orthogonal to the stirrer rotation axis, and said lever includes a projecting portion in one of its ends, intended to cooperate with a specific receptacle. The solution in this document, however, has a disadvantage with respect to coupler performance. This is because said clutch is actuated by operation of a cam mechanism associated with other mechanical components of the washing machine—namely the rod/lever which defines the coupling between the basket and stirrer depends not only on the washing basket filled with water (or flushing fluid) and, moreover, also requires high production costs due to the additional devices necessary for its proper operation.

In this scenario, we highlight the "floating" couplers which are automatically switched according to the presence or absence of water in the environment in which they are arranged. The use of said "floating" couplers becomes interesting in this type of appliance equipment, since the presence or absence of water is inherent in the phases of the washing cycle.

In this sense, it is possible to mention documents U.S. Pat. No. 5,586,455A, US20130312462, BRPI0605507, U.S. Pat. No. 6,951,121, U.S. Pat. No. 5,651,277, US20140182066, U.S. Pat. No. 6,634,193, KR2003024962, CN202193983, KR2005113452, CN203411812, CN203440675, CN2256898 and CN201151827 that each has its own peculiarity, however—and common way among them—all describe washing machines having floating couplers capable to couple concentric and/or collinear axis, and said formed couplers primarily by tubular moving bodies, similar to gloves or cups which comprise toothed surfaces capable of engaging the corresponding teeth provided on the surfaces of said axles due to the vertical linear displacement (up and down) in accordance with the presence or absence of a rinsing fluid (water) during the phases of the machine cycle (washing and centrifugation, for example), so as to transmit, or not, torque between these axes.

This type of solution shows a drawback, because it demands that the components involved in the coupling (axles and coupler) are all aligned with each other, making it difficult to assemble the equipment and generate manufacturing costs related to machining of teeth and the coupler axis (or the mold to manufacture of it, case made of polymer injection, for example).

In an alternative constructive solution, document BRPI1103238 is recited, which aims to solve the problem of selective coupling between basket and stirrer, specifically during the washing steps and centrifugation in particular. This document, however, has a crucial feature of the present invention and other documents cited herein, which consists in the fact that selective coupling occurs by flotation or not the rotating basket per se, and not an intermediate coupler in relation to the basket and stirrer.

Another solution to that issue is described in document BRPI8806595, which provides an intermediate coupler (called "locking device" in the document text in question) between basket and stirrer. Briefly, the solution described by BRPI8806595 (shown in FIGS. 1.1 and 1.2 appended) refers to a first selective locking device (see reference numeral 130) between the basket and the stirrer which is able to switch its position due to the thrust force/gravity generated when filling/emptying the washing basket, wherein said locking device is a skilled floating body to accommodate and move vertically and inwardly along a path defined by walls and receptacles arranged in the basket bottom and stirrer base.

Moreover, said document also envisages a second locking device (see reference numeral 180) disposed between the basket and the wash tank, with both the locking devices 130, 180 being similar in construction and concept, but operating opposing the response to the level of wash liquid. Such a functional difference is primarily due to the dimensioning of each of the enclosures, as well as the own locking devices 130, 180. Occurs, however, that the locking solution disclosed in this document operates so that when the water fills the tank, the locking devices float and prevent the rotation of the basket with the stirrer, and only lock the rotating basket relative to the fixed tank—which can cause undesirable noises. Further, for the locking by means of cylindrical floats as shown in FIGS. 1.1 and 1.2 appended to operate properly, they must necessarily be arranged aligned, since it must be in a same radial position relative to the rotating shaft of the stirrer—which is also a factor that can cause noise during operation of certain stages of the cycle (mainly spin).

In other words, the first locking device 130, when the basket is fed with water, said locking device 130 floats and unlocks the basket stirrer, but when said basket is emptied, the locking device 130 "falls" and performs the lock. On the other hand, for the second locking device 180, when the tank is fed with water, said locking device 180 floats and lock the tank to the basket, but when said tank is emptied, the locking device 180 "falls" unlocking the basket from the tank. Another of the major disadvantages of said document is its construction technique, once it is necessary at least two floating members in a hole and axis fitting system where the shaft is the float member and the stirrer must have holes. As the hole and axles fitting movement will be promoted by the thrust of the water, it is necessary holes of large diameters in both the stirrer and the basket, which sacrifices efforts resistance of the two components, thus limiting the torque required for washing the clothes.

Thus, it appears that, despite some "floating" couplers, more particularly those disclosed by the above-indicated documents prove, in a way, functional to the present day, it is observed that they all require constructive solutions simple that can offer satisfactory benefits for the selective and automatic coupling between basket and stirrer without its disposal/location is a hindrance to appliance equipment manufacture or design as a whole and in order also to promote a significant reduction in noise that occur during the stirring step of the washing cycles.

OBJECTIVES OF THE INVENTION

Therefore, in view of all the above, the present invention aims to disclose a laundry household appliance equipment provided with floating coupling system able to ensure the selective coupling between the rotating basket and the stirrer member effectively, economically and easy to use and assembly.

It is also object of the present invention that said selective coupling is of automatic manner as a function solely of the existing water level in the basket.

Further, it is an object of the present invention facilitate the design of the appliance equipment, as well as the assembly thereof, by the possibility of arranging the coupler and the portions with which it cooperates in any of the basket region and/or the stirrer.

SUMMARY OF THE INVENTION

Thus, in order to achieve the objectives and technical purpose above reported, the present invention relates to a floating coupling system for laundry appliance equipment comprising basically a structural enclosure surrounding a tank inside which are concentrically arranged to a mobile basket and a cooperating stirrer with at least one electric engine, characterized by the fact that it comprises: at least one cooperating coupler pivotally and simultaneously with the moving basket and the stirrer, said coupler comprising one rotatably articulated rod relative to a pivot which cooperates with the basket and is disposed orthogonal to the longitudinal axis of the stirrer, with one end of the coupling rod cooperating with at least one first coupling member and the other end the rod cooperates with at least one floating body; wherein the basket comprises at least one housing cooperating with the floating body of the coupler; and wherein the stirrer comprises means for cooperating engagement with the first coupling member of the coupler.

Thus, when there is no water present in the basket, said coupler acquires a position in which the floating body remains within the basket housing, while the first coupling member cooperates with the coupling means of the stirrer, locking and linking the rotary movement of the stirrer basket rotational movement). On the other hand, when there is water present in the basket, said coupler makes a revolving motion that keeps the rod in a position in which the floating body and the first coupling member are respectively disengaged from the basket housing and coupling means of the stirrer, decoupling rotational movement of the stirrer of the rotational motion of the basket.

It should be noted that the first coupling member of the coupler may comprise a male like element cooperating with a female like coupling means of the stirrer or, alternatively, the first coupling member of the coupler comprises a female like element cooperating with a male like coupling means of the stirrer.

Preferably said coupling means is disposed in a misaligned position with respect to the longitudinal axis of the stirrer and the housing is disposed in a misaligned position with respect to the revolution axis of the basket.

The invention in question refers also to a laundry appliance equipment comprising at least a floating coupling system as described above.

BRIEF DESCRIPTION OF THE DRAWINGS

The features, advantages and technical effects of the present invention, as outlined above, will be best understood by one skilled in the art from the following detailed description, made by way of example and not limitation preferred embodiments of the invention, and reference to the appended schematic figures, of which:

FIGS. 1.1 and 1.2 illustrate a coupling system of the current state of the art;

DETAILED DESCRIPTION OF THE INVENTION

According to the above schematic figures, some examples of possible embodiments of the laundry appliance equipment provided with coupling between the basket and stirrer, the object of the present invention will be described in more detail below, but merely exemplary manner and not limiting. This is because the present invention may comprise different details and technical, construction, structural and dimensional aspects without, however, affect the present scope of protection.

Thus, as illustrated, the machine laundry appliance of this invention basically comprises a structural enclosure G that involves a tank 10 inside which are arranged concentrically a mobile basket 20 and a stirrer 30 cooperating with an electric engine M.

Figure 3:
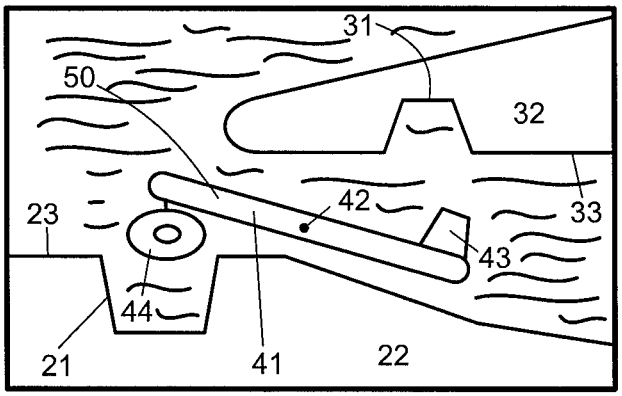
FIG. 3 illustrates an enlarged schematic view of the detail of FIG. 1 according to the preferred embodiment of the present invention, a phase of the washing cycle in which water is present in the basket
Figure 4:
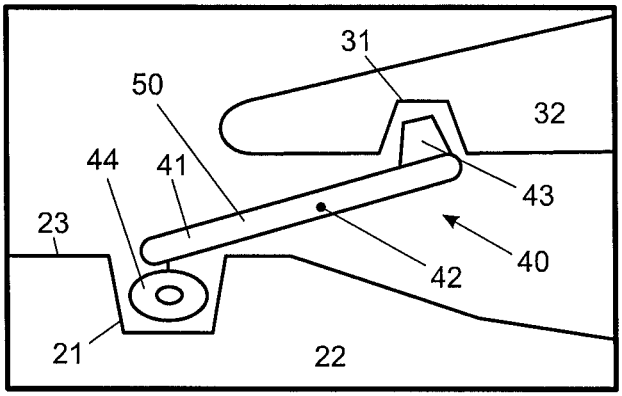
FIG. 4 illustrates an enlarged schematic view of the detail of FIG. 1 according to the preferred embodiment of the present invention, in a phase of the washing cycle in which water is absent in the basket.

According to a preferred embodiment of the invention shown in more detail in FIGS. 3 and 4 attached, the machine in question also comprises a pivoting coupler 40 preferably cooperating simultaneously and pivotally movable with the basket 20 and the stirrer 30.

The general operation of washing machine will not be detailed in detail, given that it is widely known by technicians in the field. Thus, the present description will focus on the coupling between the mobile basket 20 and stirrer 30, which is the crux of the invention described.

Said coupler 40 basically comprises a rod 41 rotatably articulated in its median portion on a pivot 42 which preferably cooperates with the basket 20 and arranged in an orthogonal position to the longitudinal axis of the stirrer 30. The link between the pivot 42 and the basket 20 can take place in different ways and therefore will not be detailed.

One end of the rod 41 cooperates with a first coupling member 43—preferably a projection or cam—and the opposite end cooperating with a floating body 44, in which said projection 43 can take any possible geometry, e.g. a trunkconic shape.

It should be noted that the floating body 44 should have lower density than the density of water and the washing liquid (water and washing inputs, mainly) as existing within the basket 20—so be able to float in the presence of liquid—and have a specific weight higher than air density to remain in the rest position in the absence of a liquid medium.

In view of the bearing rod 41 about the pivot 42 and the arrangement of the floating body 44 remote from pivot 42 at a distance which defines a lever arm 50, we have that, when the floating body 44 rises due to the thrust generated by water (or rinsing liquid) causes a torque in a first direction (clockwise for example) which is added to the torque caused by the weight of the coupling member 43, undertaken in the same direction (clockwise), and ends up winning the counter torque (counter-clockwise), caused by the weight of own floating body 44. In other words, the coupler 40 acts as a kind of see-saw in that when there is water in the basket 20, said coupler 40 remains in a first position of release movement, and when there is no water in the basket 20, said clutch 40 will remain at a second position which can be called the locking position.

Further, the basket 20 is endowed with a housing 21 capable of accommodating the floating body 44, while the stirrer 30 is provided with a receptacle or female like coupling member 31 capable of accommodating the male like coupling member 43. It is worth stressing that the coupling member 43 can be a male-like member to cooperate with a female coupling means 31 and optionally the coupling member 43 may have a construction such that the change into a female-like member to cooperate with a male like coupling member 31 without thereby escaping the scope of protection claimed here.

Preferably, the housing 21 refers to a cavity provided in the top surface 23 of the bottom 22 of the basket 20, while the receptacle 31 refers to a cavity provided along the lower surface 33 of the base 32 of the stirrer 30.

Thus, when the floating body 44 is not floating in water absent condition in the basket 20—such as during the spin stage of the wash cycle—will be accommodated in the housing 21 due to its weight, causing the coupling member 43 to accommodate the coupling means 31 locking the basket 20 to the stirrer 30 as shown in FIG. 3.

Figure 2:
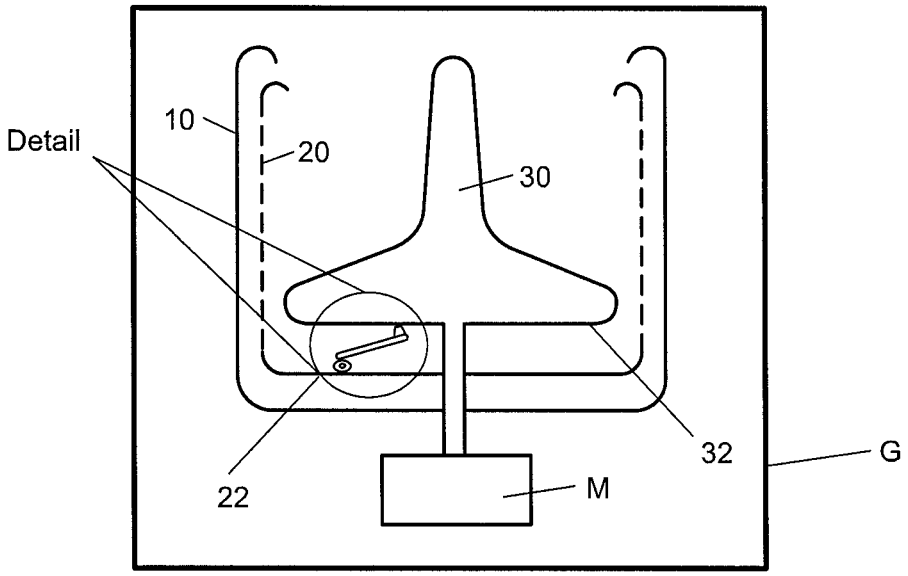
FIG. 2 illustrates a schematic view of a laundry appliance machine according to a preferred embodiment of the present invention.

However, when the floating body 44 is in the presence of water and thus floating,—as occurs during the washing cycle or rinsing of the wash cycle—it protrudes out of the housing 21, causing the coupling member 43 to protrude out of the coupling means 31, unlocking the basket 20 of the stirrer 30 and hence releasing the independent movement of both components—see FIG. 2.

This solution therefore allows to provide the selective and automatic coupling between basket 20 and stirrer 30 of a washing machine by means of an intermediate member—in this case the coupler itself 40—due solely to the presence or absence of water in the basket 20.

Furthermore, also preferably, the coupling means 31 is disposed in a misaligned position with respect to the longitudinal axis of the stirrer 30 and the housing 21 is disposed in a misaligned position with respect to the revolution axis of the basket 20. For this same purpose the pivot 42 is also preferably spaced relative to the longitudinal axis 30 of the stirrer.

Thus this construction allows a coupler 40, acting as a seesaw, can be arranged in any position near the basket 20, it is possible to scale the lever arm 50 defined on the rod 21 to "reach" the coupling means 31 provided on the stirrer 30 or housing 21 provided in the basket 20.

This type of construction makes it easy, so the design and manufacture of washing machine, as well as any repairs that are needed, despite the most state of the art solutions that uses tubular floating couplers aligned to the axes of their respective stirrers. The same argument holds in relation to the solution presented in prior document BRPI8806595.

It is worth noting that the present disclosure is for the sole purpose of describing exemplarily preferred embodiments of the washing machine according to the present invention. Therefore, it should be clear to those skilled in the art that numerous modifications are possible, variations and constructive combinations of members that perform the same function in substantially the same way to achieve the same results, which are within the defined scope of protection by the appended claims.

The invention claimed is:

1. A floating coupling system for laundry appliance equipment comprising:

a structural enclosure surrounding a tank;

a mobile basket and a stirrer arranged concentrically inside the tank and cooperating with at least one electric engine; and at least one coupler cooperating pivotally and simultaneously with the mobile basket and the stirrer, said coupler comprising a rod pivotally hinged to a pivot which cooperates with the mobile basket and is disposed orthogonal to a longitudinal axis of the stirrer, wherein:

one end of the rod of the coupler cooperates with at least one first coupling member and the other end of the rod cooperates with at least one floating body;

the mobile basket comprises at least one housing cooperating with the floating body of the coupler;

the stirrer comprises a receptacle cooperating with the first coupling member of the coupler, wherein the receptacle of the stirrer is vertically and laterally offset from the housing of the mobile basket;

when there is no water present in the mobile basket, said coupler acquires a position in which the floating body remains within the housing of the mobile basket, while the first coupling member cooperates with the receptacle of the stirrer, locking and attaching a rotary motion of the stirrer to a rotary motion of the mobile basket; and when there is water present in the mobile basket, said coupler makes a rotary movement which keeps the rod in a position in which the floating body and the first coupling member are respectively uncoupled from the housing of the mobile basket and the receptacle of the stirrer, decoupling the rotary motion of the stirrer and the rotary motion of the mobile basket.

2. The floating coupling system according to claim 1, wherein the first coupling member of the coupler comprises a male-like member cooperating with the receptacle of the stirrer having a female type coupling.

3. The floating coupling system according to claim 1, wherein the first coupling member of the coupler comprises a groove type member cooperating with the receptacle of the stirrer having a male-type coupling.

4. The floating coupling system according to claim 1, wherein the housing is disposed in a misaligned position with respect to a basket revolution axis.

5. The floating coupling system according to claim 1, wherein the receptacle is disposed in a misaligned position with respect to the longitudinal axis of the stirrer.

6. The floating coupling system according to claim 1, wherein the rod, the floating body and the first coupling member are positioned between the stirrer and the mobile basket.

7. A laundry appliance comprising:

a tank;

a rotating basket disposed within the tank and having a housing defined within a top surface thereof;

a stirrer disposed within the rotating basket and having a receptacle defined within a bottom surface thereof, wherein the rotating basket and the stirrer rotate concentrically within the tank, and wherein the housing is in an offset position with respect to the receptacle;

a lever arm positioned between the rotating basket and the stirrer and attached at a pivot to one of the rotating basket and the stirrer, the lever arm having a float attached to an end of the lever arm and a first coupling member attached to an opposing end of the lever arm; wherein the lever arm defines a locked position when no water present in the rotating basket, the locked position characterized by the float of the lever arm disposed within the housing of the rotating basket and the first coupling of the lever arm disposed within the receptacle of the stirrer to synchronize rotational movement of the stirrer with rotating movement of the rotating basket; and the lever arm defines an unlocked position when water is present in the rotating basket, the locked position characterized by the lever arm being distal from each of the housing and the receptacle and decoupling the rotational movement of the stirrer and the rotating movement of the rotating basket.

8. The laundry appliance of claim 7, wherein the housing of the rotating basket is misaligned with respect to the receptacle of the stirrer.

9. The laundry appliance of claim 7, wherein the receptacle is misaligned with respect to a rotational axis of the stirrer and is vertically and laterally offset from the housing of the rotating basket.

* * * * *